United States Patent [19]

Albright

[11] 4,429,314

[45] Jan. 31, 1984

[54] MAGNETOSTATIC ELECTRICAL DEVICES

[76] Inventor: Eugene A. Albright, 1742 W. Rose, Phoenix, Ariz. 85015

[21] Appl. No.: 903,700

[22] Filed: May 8, 1978

Related U.S. Application Data

[63] Continuation-in-part of Ser. No. 739,429, Nov. 8, 1976, abandoned.

[51] Int. Cl.[3] ..... H01Q 7/08

[52] U.S. Cl. ..... 343/788

[58] Field of Search ..... 343/787, 788, 908, 872, 343/873, 700 MS; 333/30 M, 79, 243; 365/59, 62, 132; 252/62-54; 174/36

[56] References Cited

U.S. PATENT DOCUMENTS

| | | | |
|---|---|---|---|
| 2,122,893 | 7/1938 | Roosenstein | 343/787 |
| 2,748,386 | 5/1956 | Polydoroff | 343/787 |
| 2,824,306 | 2/1958 | Pfaff | 343/788 |
| 2,831,921 | 4/1958 | Morgan, Jr. | 333/243 |
| 3,066,233 | 11/1962 | Miller | 252/62.54 |
| 3,411,111 | 11/1968 | Meyers, Jr. | 343/787 |
| 3,811,128 | 5/1974 | Munson | 343/700 MS |
| 4,104,600 | 8/1978 | Mayer | 333/243 |

FOREIGN PATENT DOCUMENTS

| | | | |
|---|---|---|---|
| 1175763 | 8/1964 | Fed. Rep. of Germany | 174/36 |
| 2461611 | 7/1976 | Fed. Rep. of Germany | 174/36 |

*Primary Examiner*—Eli Lieberman

*Attorney, Agent, or Firm*—LaValle D. Ptak

[57] ABSTRACT

Electrical devices such as antennae, electrical guitar pick-ups, speaker coils and the like, exhibiting substantially improved operating characteristics, are fabricated by embedding the conductive wire for the antennae and other devices in a permanent ceramic magnet, typically formed of an epoxy or thermosetting resin containing a colloidal suspension of magnetically hard materials such as isotropic barium ferrites or anisotropic barium ferrites. The resultant device transfers increased levels of the existing energy signal to and from the embedded conductor.

8 Claims, 36 Drawing Figures

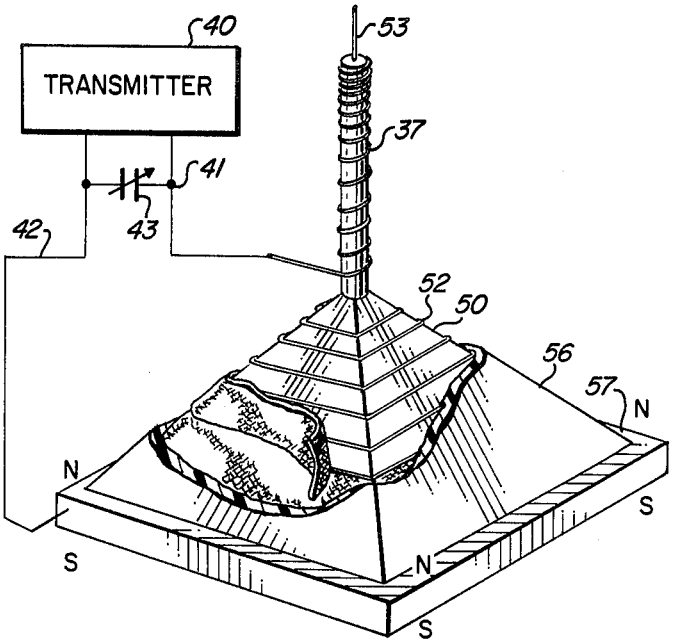
FIG-16
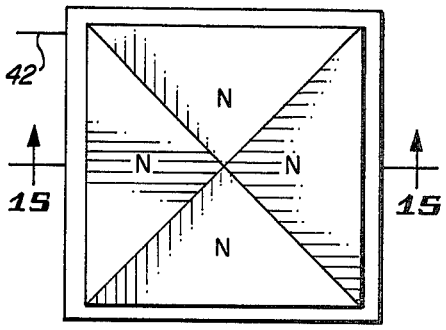
FIG-14
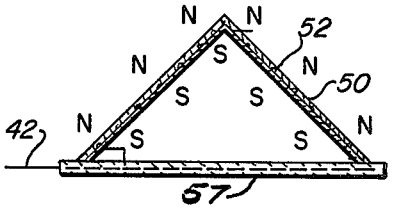
FIG-15
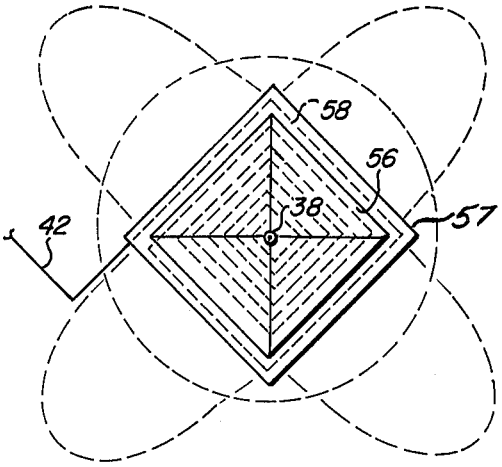
FIG-17
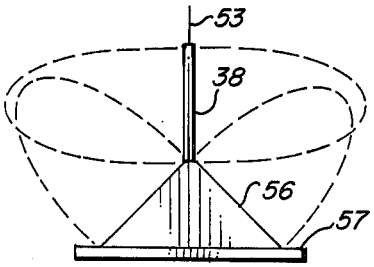
FIG-18
FIG-19
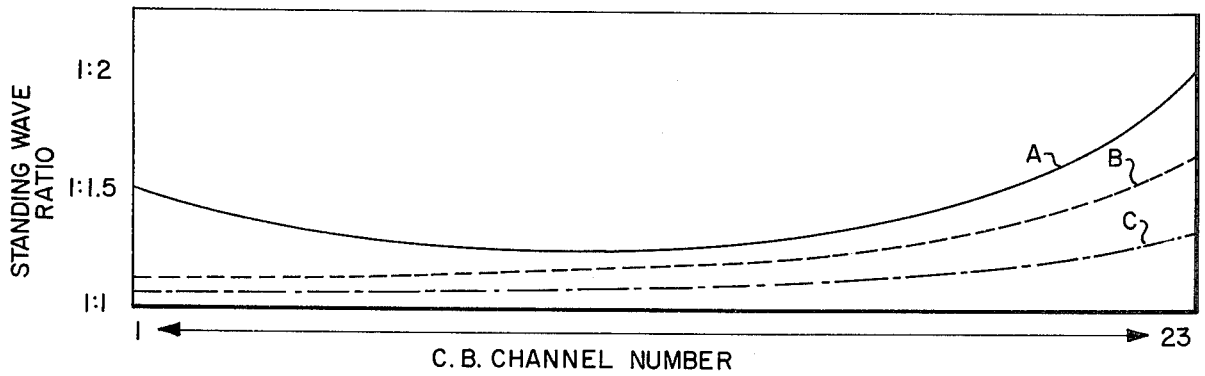

MAGNETOSTATIC ELECTRICAL DEVICES

RELATED APPLICATIONS

This application is a continuation-in-part of co-pending application, Ser. No. 739,429, filed on Nov. 8, 1976 and now abandoned.

BACKGROUND OF THE INVENTION

The energy present in a magnetostatic structure has been used in a wide range of applications, such as loudspeakers, microphones, generators, electric guitar pickups and the like. The generation of a voltage in a conductor by the changing of a magnetostatic structure or the movement of a magnetostatic structure relative to the conductor is an old concept. These devices in the prior art commonly used a permanent magnet made of electrically conducting metal. Since magnets made of electrically conducting metals rapidly attenuate any electromagnetic energy, as do any electrical conductors, the use of such permanent magnets in conjunction with these various devices has been primarily limited to core elements inside electrically insulated conductor coils or similar applications.

With the advent of ceramic magnetic materials, magnets which are not electrical conductors have become available. Ceramic magnets are available in both permanent (hard) magnetic materials or magnetically soft materials. Various types of ceramic magnetic compositions of both the hard and soft types use "ferrite" materials. Generally these materials are magnetically soft materials (that is nonpermanent magnets). "Hard" or permanent magnet materials are high loss high retentivity, high coercivity materials with low permeability.

The coercive force of hard magnetic materials is on the order of tens of thousands of times greater than that of the lowest coercive force of soft magnetic materials. From a magnetic softness view point, the important thing to regard is the hysteresis loop. For soft magnetic materials the area of the hysteresis loop is quite small, whereas for "hard" magnetic materials the area of the hysteresis loop is large by comparison with soft materials. The bulk of the work in electric circuit design using magnetic materials involves the application of magnetically soft cores in inductors and transformers and the like. These uses encompass a large range of ferrite and metal cores and the applications of permanent magnets (metal or ceramic) in electronic circuit design has been nearly neglected.

Soft ceramic ferromagnetic materials and ferrite materials have been employed as coatings or cores for radio frequency transmitters and receivers to increase the inductance of the antennae which in turn permits reductions in the antennae lengths or sizes. Antennae which have been modified with such soft magnetic materials (high permeability materials) are known, and such antennae systems are disclosed in U.S. Pat. No. 2,748,386 issued May 29, 1956. Since the prior art antennae of the type disclosed in U.S. Pat. No. 2,748,386 rely upon inductive coupling, the high permeability (inductance) available in the soft ferromagnetic or ferrite materials is desired. While some improvements in the operation of antennae systems which are treated with these "soft" magnetic materials do result, the differences between such treated antennae and conventional antennae are not significant.

Antennae for use in conjunction with various types of radio frequency transmitters and receivers are well known. The variety of shapes and electrical configurations of antennae is almost limitless. These range from end-fed antennae, which are substantially linear conductive rods of various lengths having specific relationships to the wavelengths of the frequency of the signals transmitted from or received by such antennae, to complex arrays of components. Helical antennae, as well as composite antennae involving combinations of various antenna shapes and configurations such as complex lens antennae, multiple-tuned antennae, dipoles and the like are well known. The particular configuration which is employed for any specific purpose is selected in order to function properly with respect to the frequencies which are involved and the radiation patterns desired.

Irrespective of the type of antenna or antenna configuration which is employed, all antennae, both transmitting and receiving antennae or those used for both functions, are subject to limitations in the power gain of any given antenna due to what is known as "skin effect". This phenomenon is one of non-uniform current distribution over the cross section of an alternating current conductor. At high frequencies, the current for a conductor is carried only by a thin surface layer of the conductor, the thickness of the layer decreasing with increasing frequency. The result of this phenomenon is a self-induced counter-electromotive force in the conductor which results in considerable cancellation of the received energy and increased effective resistance.

Thus, the gain or power of the antenna, whether it is a transmitting antenna or a receiving antenna, is reduced from the theoretical ideal which it could exhibit if "skin effect" was not present. This means, for a receiving antenna, the capability of the antenna to respond to weak signals is substantially impaired. The signal-to-noise ratio is lowered; and for any given receiver, it is necessary to employ substantially greater gain in the RF stages than would otherwise be necessary for the same reception capabilities if the undesirable effects of "skin effect" were not present. Similar disadvantages result with respect to transmitting antennae, the power of which is substantially impaired by the increased effective resistance produced by skin effect. Thus, for any given transmitted power, the power of the output amplifying stages must be considerably higher than would otherwise be required if "skin effect" phenomenon was not present. As stated above, as the frequency of the carrier signal increases the deleterious effects of skin effect increase proportionately.

As is well known, communications systems in a wide variety of different forms, such as AM radio, FM radio, television, two-way FM communications such as used in citizens' band (CB) radios, police and fire communications networks and the like are in widespread use throughout the world. These communications systems utilize the transmission and reception of electromagnetic radio frequency waves which are radiated through space from a transmitting antenna at the originating source or station to a receiving antenna at the point of utilization. The radio frequency waves extend in frequency from a relatively low 10 kilohertz up into frequencies of hundreds of megahertz. Different portions of this spectrum are divided into different frequency bands allocated to various systems of transmission. The moving electromagnetic radio frequency waves which are radiated through space are created at the transmitting station by coupling the transmitter output to an antenna which has a configuration particularly adapted to the frequency of the transmission and the use or application of the signal in the particular system with which the transmitter and antenna is employed. At the receiving end, a receiver which is used in conjunction with the transmitted signal to receive and convert it to a usable form, such as audio or visual, has an antenna which intercepts the moving electromagnetic waves and converts them to electrical signals which are processed by the receiver.

In conventional antennae, both transmitting and receiving, the antenna itself is what may be termed a "passive" component in the system. At the transmitting end, the alternating current signal creates electromagnetic radiation when it is applied to the antenna. At the receiver, the moving electromagnetic wave is intercepted by the conductive antenna and results in the generation of a corresponding alternating current electrical signal in the conductor which then is applied to the RF amplifier and processing stages of the receiver. These conventional antennae are electrical devices only. The transmitter generates an electrically polarized electromagnetic wave and the receiver responds to the electrical components and resonates with the corresponding electrical polarization of the electromagnetic wave. Because of the "skin effect" mentioned above, at higher frequencies the thickness of the layer of the conductor in the antenna which actually carries the current becomes increasingly thinner and results in an increasing counter-electromotive force. This, in turn, results in increased effective resistance in the antenna and correspondingly greater self-cancellation. Thus, at higher frequencies, the power of an antenna, either a transmitting antenna or a receiving antenna, is substantially lessened by "skin effect".

In order to provide sufficient power, either for transmission or reception, for conventional antennae in any given situation, it often is necessary to have extremely large antenna structures or antenna towers to attain the desired operating characteristics of the transmitter or receiver. Such structures are costly to build; and because of the substantial space they require or the substantial height to which they must reach, result in expensive, cumbersome and unattractive installations. For example, bulky rooftop television receiver antennae are commonly employed in order to provide some measure of reasonable reception for television receivers used in homes. Similarly, two-way radio antennae, such as used for ham radio operators, CB radio base stations, and the like require large unsightly installations if any reasonable range is to be attained from the radio system using the antenna. In addition, mobile antennae used by police cars and CB installations in automobiles and trucks, for maximum effectiveness over a reasonable range, require a relatively long "whip" antenna structure.

It is desirable to provide transmitting and receiving antennae in a variety of configurations which have relatively high power capabilities, minimum size, and which eliminate or substantially minimize the "skin effect" self-cancellation phenomenon ordinarily encountered in antennae structures. In addition, it is desirable to increase the coupling between the coils of a guitar pick-up, speaker, microphone or other devices using coils and magnetostatic energy to improve the operation of such devices.

SUMMARY OF THE INVENTION

Accordingly, it is an object of this invention to provide an improved electrical circuit component.

It is another object of this invention to provide improved electrical circuit components using magnetostatic structures with electrical conductors embedded in permanent ceramic magnets.

It is an additional object of this invention to provide improved electrical devices using magnetostatic structures.

It is a further object of this invention to provide an improved antenna structure.

It is still another object of this invention to provide an improved magnetic antenna.

It is yet another object of this invention to provide an improved magnetic antenna structure utilizing a conductor embedded within a permanently magnetized ceramic dielectric material.

In accordance with a preferred embodiment of this invention an electrical circuit component comprises electrical conductor embedded inside a permanently magnetized magnetically hard dielectric material.

More specifically, a magnetic antenna exhibiting substantially improved operating characteristics is fabricated by embedding a conductive wire for the antenna in ceramic dielectric material formed of a resin with a colloidal pension of hard magnetic ferrite particles in it and which is permanently magnetized.

BRIEF DESCRIPTION OF THE DRAWINGS

FIGS. 13A through 15 illustrate other forms of antenna structure;

FIG. 16 is a partially cut-away view of an antenna structure using a base member structure as illustrated in FIGS. 13C, 14 and 15;

FIGS. 17 and 18 show radiation patterns of the antenna of FIG. 16;

FIG. 19 is a graph showing standing wave ratios useful in explaining the operation of the antenna structure shown in FIG. 8;

DETAILED DESCRIPTION OF THE PREFERRED EMBODIMENT

Figure 1:
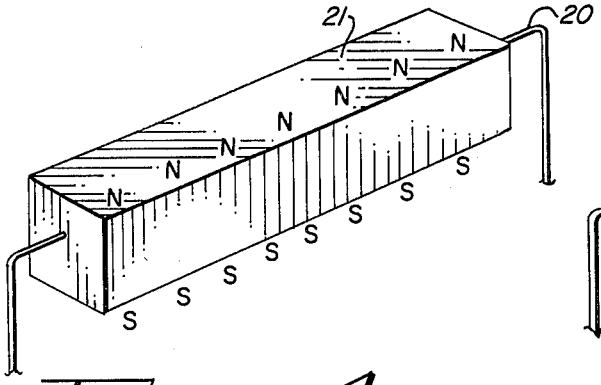
FIG. 1 is a perspective view of a preferred embodiment of the invention.
Figure 2:
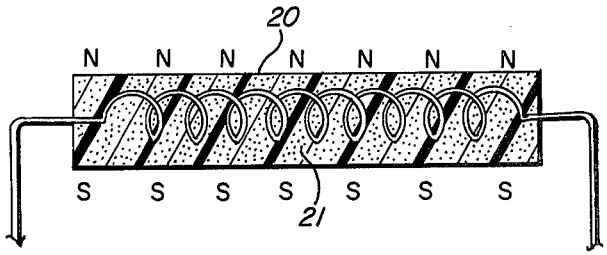
FIG. 2 is a cross-sectional view of the embodiment shown in FIG. 1.

In FIGS. 1 and 2, there is illustrated a new approach to electrical components, particularly conductive elements used either as transmitting or receiving antennae. As shown in FIGS. 1 and 2, a helical conductive coil 20 is embedded or potted in a conventional dielectric potting compound, such as a resin binder (epoxy or thermosetting) or rubber to form what appears to be a conventional potted electrical component 21. The resin binder for the potted component 21, however, when it is in its liquid state, has a quantity of magnetically "hard" ceramic type ferrite powder mixed in it to form a uniform colloidal suspension of ferrite particles in the liquid epoxy. The amount of ferrite may be varied from an amount approximately five percent by weight of the mixture to ninety percent by weight, depending upon the characteristics desired in the components produced. In most cases the higher concentrations are used. Preferred ferrites are isotropic or anisotropic barium ferrites ($BaFe_{12}O_{19}$), such as Ferroxdure and the like.

When the epoxy/ferrite for the component mixture 21 cures and becomes hard, it then is subjected to a magnetizing field to impart a permanent magnetization to it as indicated by the "N" and "S" letters placed on the top and bottom, respectively, of the component shown in FIGS. 1 and 2. When this is done, the use of the component shown in FIGS. 1 and 2 as an antenna, either in a transmitting antenna or a receiving antenna, has the conductive wire embedded in a magnetically hard ceramic permanent magnet. This results in an antenna component which is an active generator or amplifier rather than the conventional passive component normally used.

When the component is used as a part of a receiving antenna, the moving radio frequency electromagnetic energy passing over it is amplified through a principle believed by the inventor to be caused by changes in the magnetic field of the RF wave interacting with the permanent magnet of the magnetic dielectric material 21 which then is coupled to the conductive coil 20 in the manner of a transformer. It further is believed that by using the changing magnetic energy of the RF field instead of or in addition to the changing electrical energy, the deleterious skin effects normally associated with antenna components are either eliminated or substantially minimized since the entire magnetostatic structure carries the energy, not just the surface as with conventional antennae. In any event, an antenna constructed in accordance with the structure shown in FIGS. 1 and 2 generates energy at the same frequency and modulation as the passing RF energy but with much greater amplitude than is possible with the same conductive portion or coil 20 used alone without embedding it in the ceramic permanent magnet. Since the ceramic magnet is not a conductor, it does not attenuate electromagnetic energy in contrast to the significant attenuation of electrically conducting metals.

It also should be noted that the coil or conductor 20 is inside the magnet which is in contrast to winding the coil around a magnet or magnetic material. This is in direct contrast to the construction of known ferrite antennae where the coil is wound around an unmagnetized ferrite core.

The material 21 may be formed using a large number of various types of thermosetting or epoxy resins, and the hard magnetic particles or powder also may be in a number of different forms. Permanent magnets made of such materials are conventional and are made in a number of different shapes for various applications. Use of magnets of this type, however as an active circuit part of an antenna or other electrical circuit is not known to the inventor.

Figure 3:
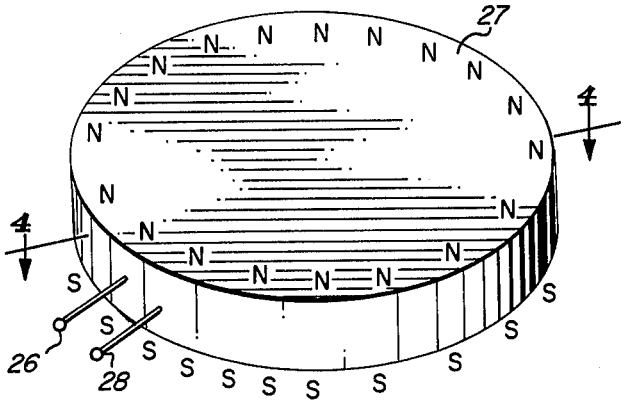
FIG. 3 is a perspective view of another embodiment of the invention.
Figure 4:
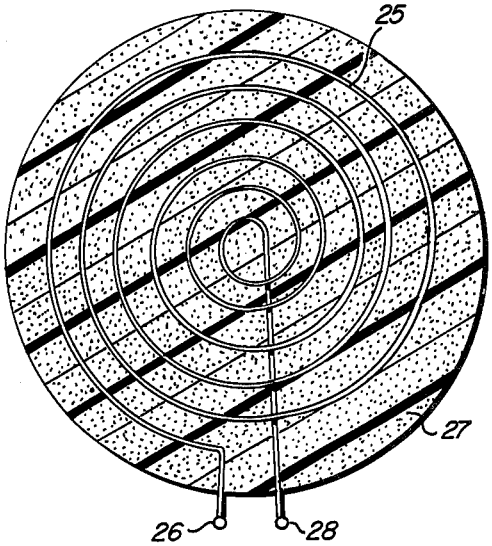
FIG. 4 is a cross-sectional view of the embodiment of FIG. 3.

FIGS. 3 and 4 illustrate another antenna configuration utilizing the same principles shown in the structure of FIGS. 1 and 3. In the antenna structure of FIGS. 3 and 4 the active conductive component of the antenna comprises a flat spiral antenna element 25 terminating in a pair of terminals 26 and 28, connected respectively to the outer and inner ends of the spiral 25. The conductive spiral component of the antenna is potted or embedded in an epoxy/hard magnetic ceramic ferrite-powder mixture of the type described above in conjunction with FIGS. 1 and 2. As in FIGS. 1 and 2, the flat disk 27 resulting from the structure after it cures or hardens is subjected to a uniform magnetizing field to permanently magnetize it across its thickness, as shown in FIG. 3.

An antenna as shown in FIGS. 3 and 4 may be used as an AM radio receiving antenna. Without placing the coil 25 in the center of a permanent magnet, the power output of the antenna is quite low. The same coil, potted in a suitable epoxy or thermosetting resin having suspended ferrites in it and then permanently magnetized, however produces a substantial increase in the signal power from the antenna. An active generator or amplifier is obtained with the structure of FIGS. 3 and 4 which combines a permanent magnet with the embedded coil 25.

An actual antenna, built with the structure of FIGS. 3 and 4 used 20 feet of #22 copper wire embedded in a ceramic magnet (13 inch diameter), magnetized to 2,000 gauss per square centimeter. This antenna detected electromagnetic energy (550 to 1500 kc) and produced 5/100 volts output in the presence of local radio stations in Phoenix, Arizona.

Various ratios of ferrite powder, preferably barium ferrite or cobalt ferrite, have been used to construct the antenna of FIGS. 3 and 4. The ratio of barium or cobalt ferrite powder to the resin used in actual antenna structures has been varied from a ratio of approximately twenty percent of the ferrite powder by weight to ninety percent. Throughout this entire range, substantially increased power output was obtained as opposed to conventional antennae which do not use the dielectric permanent ceramic magnet principle illustrated in FIGS. 1 through 4.

The optimum percentages for a given antenna structure have not yet been determined; but the antenna structures which have been built clearly show that the combination of the dielectric permanent magnet and the antenna coil generates energy at the same frequency and modulation as a comparable antenna coil without the permanent magnet, but at a substantially greater amplitude than the conventional antenna. It is believed that this is caused by the interaction of electromagnetic waves with the ceramic permanent magnet in a manner to utilize both the current and voltage portions of the electromagnetic energy, resulting in a significant measured increase in the power of the antenna. Conventional antennae use only the current part of the electromagnetic energy.

An antenna for the FM frequency band was built in accordance with the structure shown in FIGS. 3 and 4 by winding approximately 36 feet of wire 25 into a very loose coil of approximately 12 inches diameter. A mixture of 40% hard magnetic barium ferrite powder ($BaFe_{12}O_{19}$) to 60% resin was used to fill a mold approximately 1 inch thick. The wire coil or spiral 25 was then placed in the center of the mold, which placed the coil 25 in the center of the magnetic material after it hardened. Following hardening of the material, it was permanently magnetized, as shown in FIG. 3. The gain of this antenna was measured to be 500% to 700% of the gain of a standard soft magnetic ferrite antenna used as a built-in antenna in a quality FM tuner. With the built-in ferrite antenna, the tuner was capable of receiving only 5 local stations in full stereo (antenna voltage over 10 microvolts). With no change in the location of the receiver, but using the antenna described above, the receiver received 14 stations in full stereo, including an FM station located one-hundred twenty-five miles away. The antenna of FIGS. 3 and 4 produced a gain which is nearly as good as large conventional roof-mounted antennae.

Figure 5:
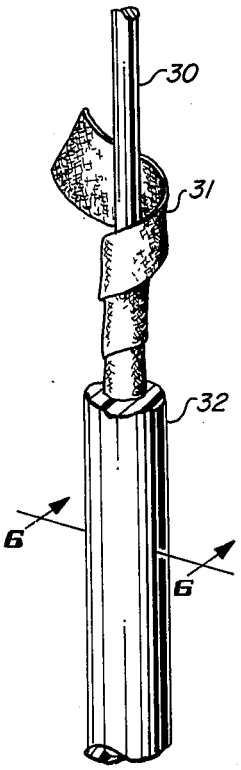
FIGS. 5 and 6 illustrate another embodiment of the invention.
Figure 6:
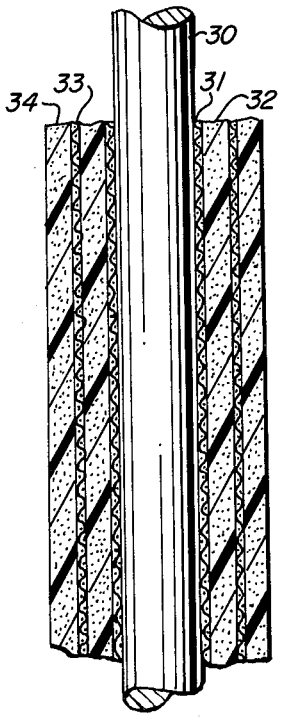

Referring now to FIGS. 5 and 6, there is illustrated a modification of a standard whip antenna 30, the power of which is increased by applying the principles of this invention to it. The antenna 30 may be any conventional whip antenna of the type ordinarily used in mobile communications. Sometimes the conductive rod of such an antenna is covered with fiber glass to reduce the effects of corrosion and the like. In most cases, however, the metal antenna rod 30 is completely exposed. As shown in FIGS. 5 and 6, the antenna rod 30 may be covered with a conventional fiber glass gauze or cloth 31 which then is impregnated with a conventional binder to which is added a colloidal suspension of a hard magnetic ceramic ferrite powder (preferably barium ferrite or cobalt ferrite belonging to the class of hexagonal ferrites, such as $BaFe_{12}O_{19}$). When this resin/ferrite mixture is applied to the fiber glass cloth 31, it hardens to impregnate the cloth 31 with a layer of ferromagnetic resin 32 indicated in FIG. 5.

The manner of application of the resin/ferrite mixture may be in accordance with conventional techniques, such as by spraying, dipping, potting or the like. If desired, as shown in FIG. 6, more than one layer may be placed around the antenna 30. In FIG. 6 an additional fiber glass cloth layer 33 and an outer or additional resin/ferrite layer 34 is illustrated. When this is done to an otherwise conventional antenna; and the resultant structure is permanently magnetized across the axis of the conductive whip 30, as illustrated in FIG. 6, the power of the antenna, both for transmission and for reception, is significantly increased several dbs. This is true even where the amount of ferrite powder in the resin binder 32 is as low as five percent of the total weight of the resin/ferrite mixture. The significant operating improvements which occur are believed to be, at least in part, caused by elimination or substantial reduction in the self-cancellation due to "skin effects" which are present in conventional (untreated) antennae. The permanent magnet coating is an active part of the antenna and the entire magnetostatic structure carries the energy (both voltage and current) and not just the thin surface of the conductor.

When an antenna structure of this type is made, the length of the whip 30 must be reduced slightly from that which is used in the conventional antenna. In an actual modification of a standard base loaded quarter-wave mobile whip antenna (41.75 inches long) it became necessary to shorten the length of the antenna by 3½ inches when a single layer of fiber glass impregnated with a magnetic resin (comprised of 20% hard magnetic barium ferrite powder) was used. The resultant structure, appears to add effective length to the antenna (capacitive reactance) caused by the permanent magnet ceramic material. Thus, it is necessary to shorten the overall length of the antenna when it is modified as shown in FIGS. 5 and 6. A modified antenna of this type exhibited substantially increased power (5 db to 6 db improvement on receive) when it was used with a standard CB radio, over that exhibited by the same antenna prior to its modification. The improvements in operating results for the antenna used as a receiving antenna are even greater than when it is used as a transmitting antenna.

Because of the nature of this structure, however, it no longer is necessary to employ a relatively heavy duty rod 30 for the conductive portion of the antenna. A whip antenna may be fabricated by using a thin copper wire embedded within a fiber glass structure formed either by wrapping multiple layers of fiber glass or by potting. The fiber glass structure, however, uses a resin/hard magnetic ceramic ferrite mixture as described above, and is permanently magnetized to form the resultant antenna. In this manner, a true fiber glass antenna is obtained, because the fiber glass becomes an active part of the circuit. Apparently, the undesirable skin effects are eliminated from the antennae of FIGS. 5 and 6. The power of these antennae is substantially higher than standard whip antennae. In addition, the signal-to-noise ratio is much improved.

Figure 7:
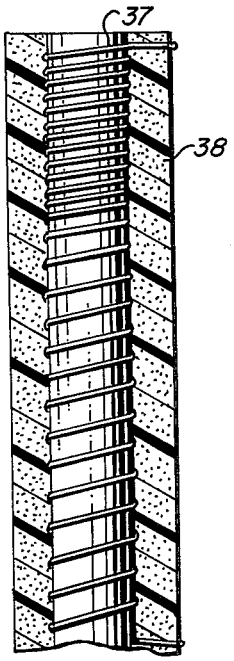
FIG. 7 shows still another embodiment of the invention.

Referring now to FIG. 7, there is illustrated a helical antenna which is particularly adapted to two-way mobile communications such as used in Citizen's Band (CB) radios. This antenna comprises a helical coil 37 which is wound with relatively open turns for the lower two-thirds of its length and which terminates in the upper third of its length with closely wound turns. The wire 37 may be wound about any suitable dielectric hollow cylinder or rod, which is then potted in an epoxy/ferrite mixture of the type described previously, or formed as part of a fiber glass enclosure 38 in the manner described in conjunction with FIGS. 5 and 6. Whatever construction is used for the magnetic dielectric covering 38 over the coil 37, it is magnetized across the axis of the coil (or radially outward from the axis) to form a permanent magnet dielectric with the coil 37 embedded in it. The dielectric/magnetic covering 38 completely encases the coil 37. The operating characteristics of this antenna, either used as a transmitting antenna or a receiving antenna, are significantly improved over a comparable antenna which does not use the permanent magnet dielectric.

A variation of the structure of FIG. 7 is effected by winding the helix coil 37 as a standard tapered linear coil. The antenna dielectric then also is constructed as a tapered linear magnetic structure. By way of example, this may be accomplished for a 36 inch antenna by dividing it into 6 inch segments. The epoxy/ferrite mixture for the lower six inches is 5% ferrite to 95% epoxy. Each of the successively higher six inch sections then has the ferrite portion increased by 5% over the adjacent lower section except for the top section. To maximize the top loading of the structure, the top six inches has a ferrite/epoxy mixture which is 80% barium ferrite and 20% epoxy. The tapered coil/tapered magnetic field antenna which results after the structure is permanently magnetized is a significantly improved top loaded antenna.

Figure 8:
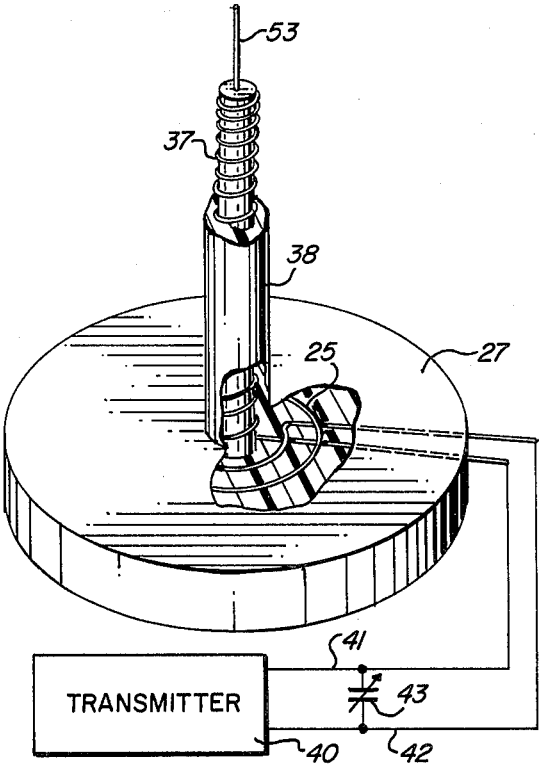
FIG. 8 illustrates another embodiment of the invention formed by a combination of the structures shown in FIGS. 3, 4 and 7.

Referring now to FIG. 8, there is shown a composite antenna made of a spiral antenna structure, such as shown in FIGS. 3 and 4, forming the base, and a vertical helical antenna, such as shown in FIG. 7, attached to and extending upwardly from the spiral antenna base. The input feed is to the center of the spiral 25 and the lower end of the base of the vertical helix 37. The outer end of the spiral and the upper end of the helix are open, so that the resultant antenna is of the Hertz type.

An antenna of this type has been constructed to provide a $\frac{7}{8}$ wave antenna, with the base spiral wound in the form of a 12 inch coil. The spiral was formed with 540 inches of number 14 wire as follows:

4 turns at 12 inches - 144 inches
3 turns at 11 inches - 99 inches
2 turns at 10 inches - 60 inches
2 turns at 9 inches - 54 inches
2 turns at 8 inches - 48 inches
2 turns at 7 inches - 42 inches
2 turns at 6 inches - 32 inches
2 turns at 5 inches - 30 inches
2 turns at 4 inches - 24 inches
2 turns at 3 inches - 18 inches The helical vertical portion of the antenna was formed with 31 turns of number 14 wire close-wound at the top (18 inches) with 46 turns loosely wound at $\frac{1}{4}$ inch spacing below this. The total height of the vertical helical portion of the antenna was 14 inches. The upper turn terminated in a vertical 6 inch stub 53.

A transmitter 40 is coupled with the upper or "hot" lead 41 connected to the bottom of the helical conductor 37 of the antenna, and the ground lead 42 is connected to the center end of the spiral base spiral conductor 25. Magnetization of the base portion 27 is vertically through its thickness as shown in FIGS. 4 and 5; and magnetization of the dielectric/ferrite material 38 in which the helical conductor 37 of the antenna is embedded is across its axis as shown in FIG. 7.

Figure 9:
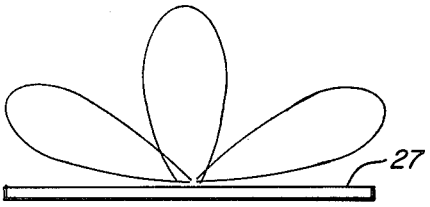
FIGS. 9 through 12 illustrate various radiation patterns for the antenna of FIG. 8.
Figure 10:
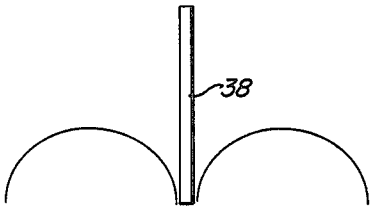
Figure 11:
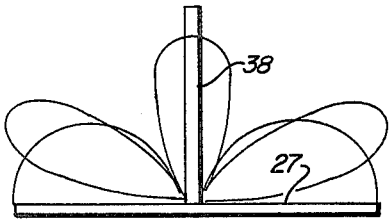
Figure 12:
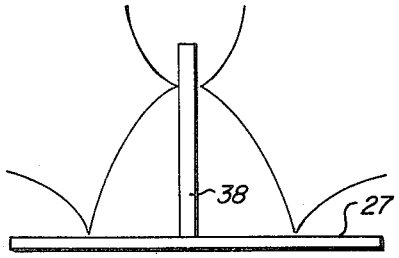

FIGS. 9, 10, 11 and 12 illustrate the current standing wave patterns contributed by the different parts of the composite antenna of FIG. 8. FIG. 9 shows the current standing wave pattern contributed by the flat spiral base portion 27. FIG. 10 shows the current standing wave pattern contributed by the vertical helix portion 37, 38, and FIGS. 11 and 12 show the composite current standing wave pattern which results from phase differences (in phase and 180° out of phase) between the patterns contributed by the antenna parts. All of these patterns result from the antenna being located on a metal ground plane.

Figure 13A:
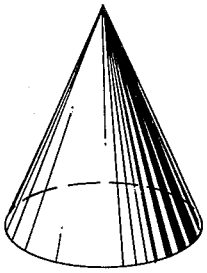
Figure 13C:
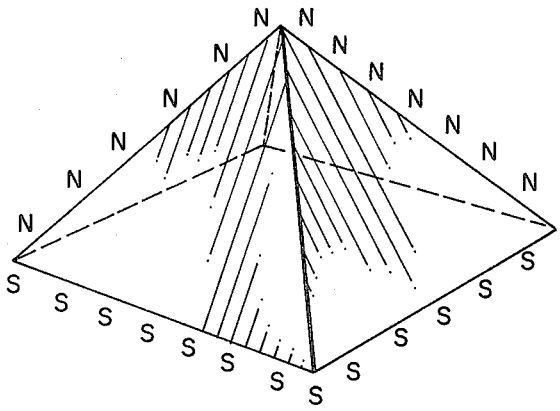
Figure 13B:
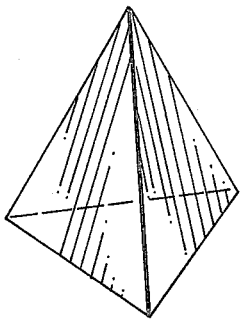

Antenna structures other than those described previously also are possible using the principles of this invention. For example, base configurations such as shown in FIGS. 13A, 13B and 13C may be employed. These base configurations for winding spiral or helical conductive wires to form the inner embedded conductive member of the antenna may be used either alone or in a number of configurations. The bases or at least the portions of the base forms in which the conductive wire of the antenna is embedded are made of resin/ferrite mixtures of the type described previously in conjunction with the other embodiments of the invention. After the antenna structures are formed, they are permanently magnetized, for example, as illustrated in FIG. 13C and FIGS. 14 and 15 for the four-sided pyramid base shape illustrated in those Figures.

Referring now to FIG. 16, there is shown a composite antenna which is formed on a pyramid base 50 of the type illustrated in FIGS. 13C, 14 and 15 to which is added a flat base 57 with a square spiral winding 58 which are similar to the member 27 and winding 25 of FIGS. 3 and 4. The base 57, however, is only magnetized in the region lying outside the edges of the pyramid 50. The base 50 is formed of a suitable dielectric material, preferably which is impregnated with a ferrite powder in the proportions described previously, that is, from 5% to 90% by weight of hard magnetic ferrite to resin. On the form 50, a spiral coil 52 is wound in a pattern to match the square spiral 58 shown in FIG. 17. At the apex of the pyramid, a vertical helical antenna component 37, 38 of the type shown in FIG. 7 is placed, much in the same manner as in the composite antenna of FIG. 8, previously described. The lead 41 of the transmitter 40 then is connected to the lower end of the helix 37 and the lead 42 is connected to the outer end of the flat spiral 58. The inner end of the spiral 58 is connected to the lower end of the winding 50, the other end of which is open. Tuning of the antenna may be effected by use of the trimmer capacitor 43.

After the windings 37 and 52 are in place, a fiber glass gauze or winding 55 is wound over the exterior of the pyramid base and over the helical antenna winding 37. The fiber glass gauze 55 then is impregnated with a resin/hard magnetic ferrite mixture 56, which is allowed to harden. Finally, the base is magnetized to form a permanent magnet with the poles as shown in FIGS. 14 and 15. The vertical portion of the antenna is constructed as shown in FIG. 7, and is magnetized across its axis. The resultant exhibits a radiation pattern of the type as shown in FIGS. 17 and 18.

An actual antenna built in accordance with the structure shown in FIGS. 16 through 18 used a pyramidal base formed of four equilateral triangles. The height of the base cone was 7 inches, and the height of the vertical helical antenna portion extending upwardly from the base of the cone was 23 inches. A 6 inch stub 53 completed the antenna which operated as a $\frac{3}{4}$ wave antenna. The standing wave ratio of this antenna over the full band of CB frequencies for CB channels 1 through 23 was measured to be nearly flat 1:1 to 1:1.2 across the full band, as illustrated in Curve C of FIG. 19. This is in contrast to a conventional whip antenna for the same band, the standing wave ratio of which is shown in Curve A of FIG. 19. Curve B of FIG. 19 illustrates a conventional whip antenna which is modified in accordance with the structure shown in FIGS. 5 and 6.

Even starting with a conventional antenna which is then potted or wrapped with fiber glass impregnated with a resin/ferrite material, as described previously, the resultant permanent magnet/antenna structure greatly increases the gain of the antenna. Gain improvements of several db have been measured. Of the various types of ferrite materials which may be employed, it appears that those belonging to the group of hexagonal ferrites, such as barium ferrite or cobalt ferrite, are the best. This probably is because of the high coercive forces which exist in these materials in their powdered form which permit them to make good permanent magnets. While the ampere turns of magnetizing force used to create the permanent magnet characteristics of the various antenna configurations described may vary, the various samples which were made and which have been described above used 24,000 ampere turns per cubic inch for permanently magnetizing materials. The magnetization preferably was effected perpendicular to the surfaces of the various antennae where possible since it appears that this is the most effective direction of polarization of the permanent magnet in which the conductive wire for the antennae is embedded. The theory which results in the improved operation of these dielectric/magnetic antenna structures is not fully understood, but the many different models of antennae which have been built, both by modifying standard antennae and by antenna structures such as shown in FIGS. 8 and 16 clearly exhibit improved power or gain and significantly improved signal-to-noise ratios over their conventional counterparts. The antennae operate with a relatively large ground plane for best results, but this is common with many radio frequency antennae. Merely placing the antenna structure of the various types shown in the drawings and described above on a large metal surface, such as the roof of a car or directly on the ground, results in the excellent operating characteristics which have been described.

The antennae of FIGS. 8 and 16 operate best from a balanced input which eliminates line radiation and causes essentially all radiation to occur from the antenna only. This causes the standing wave ratio (SWR) and impedance, once balanced to be more independent of ground effect and environment since the antennae of these Figures are ungrounded antennae.

Figure 20:
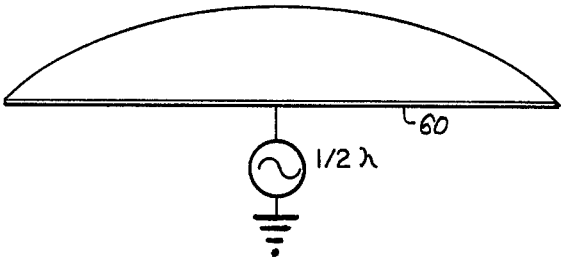
FIGS. 20 and 21 are used to illustrate radiation patterns of an embodiment of the invention.
Figure 21:
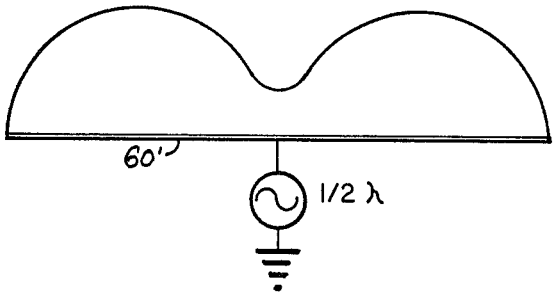

Reference now should be made to FIGS. 20 and 21 which illustrate some of the measured phenomena resulting from the treatment of a typical half-wave center-fed antenna by embedding or encasing the antenna element inside permanently magnetized hard ceramic materials in the manner described above in conjunction with the embodiments shown in FIGS. 1 through 18. FIG. 20 illustrates, in a diagrammatic form, a typical center-fed half-wave antenna.

For the purposes of this illustration, assume that the antenna of FIG. 20 is a conventional antenna which has not been modified or treated in any way with a magnetic coating. An antenna of this type acts like an inductance at the feed point connected to its center. The radiation of this conventional antenna is directly related to the amplitude of the applied current. This radiation is at a maximum at the feed center and diminishes to near zero at the ends of the antenna. This results in a generally elliptical or semi-circular radiation pattern as indicated in FIG. 20. The pattern is similar for both transmitting antennae and receiving antennae. Conventional antennae do not take advantage of the voltage portion of the generated or received energy, but return this to the electrical circuit. This is inherent in the operation of conventional antennae of various constructions.

In FIG. 21 a diagrammatic representation of the same half-wave antenna shown in FIG. 20 is illustrated; but for the purpose of the illustration of the antenna of FIG. 21, the metal conductor of the antenna is embedded in or coated with a hard magnetic permanetly magnetized ceramic coating of the type described above in conjunction with the embodiments shown in FIGS. 5, 6 and 7, for example. Thus, the antenna of FIG. 21 is modified from the one shown in FIG. 20 to become what is referred to herein as a "magnetic antenna".

It has been discovered that the generated radiation which is produced by such a magnetic antenna utilizes the voltage portion of the signal as well as the current portion; and the amplitude of the radiation component created by this voltage portion is a maximum at the ends of the antenna. It is believed that this is not a current, but is an electric-flux density, which produces a magnetic field intensity H which is proportional to the time rate of change of the electrical field producing it. Because H is proportional to the time rate of change of the electrical field when a magnetic field is produced and the electric field intensity E is proportional to the time rate of change of the magnetic field, it is possible to generate electromagnetic waves in the nonconductive ceramic magnetic materials of the antenna.

Because the time varying electric field is directly coupled in an already magnetized dielectric, an almost equal conversion of the voltage part of the energy to radiation is accomplished as with the current portion (which is the only portion utilized in conventional antenna design). The result is a significant improvement in the gain of magnetic antennae over conventional antennae. This improvement is realized whether the antenna is used as a trasmitting antenna or as a receiving antenna. The differences in gain between magnetic antennae and conventional antennae, which are similar in all respects except for the application of the permanent ceramic magnet over the antenna elements, are significant. Measured improvements ranging from three or four db to as much as eleven db have been observed. This is a highly significant improvement.

Applicant also has conducted measurements on various configurations of his improved magnetic antennae to determine the polarization, if any, of the waveforms of such treated antennae. Measurements on various types of antennae which have been constructed in accordance with the invention to embed or cover the conductive elements of the antenna in a permanent ceramic magnet indicate that two electromagnetic fields are generated at 90° out of phase and at right angles to one another. These conditions are necessary for the generation of a circularly polarized waveforms, and the results of circular polarization have been measured in accordance with the Vector diagrams shown in FIGS. 22A through 22D for a typical sinusoidal waveform 22E.

Figure 22A:
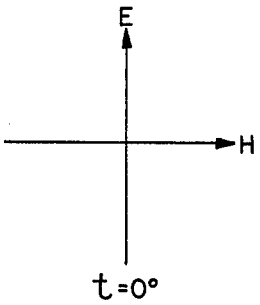
FIGS. 22A to 22E illustrate the polarization of antennae made in accordance with the invention.
Figure 22B:
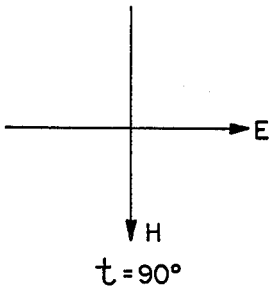
Figure 22C:
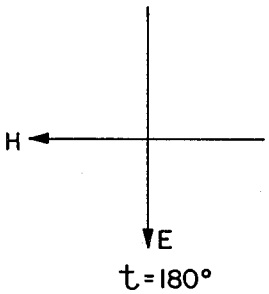
Figure 22D:
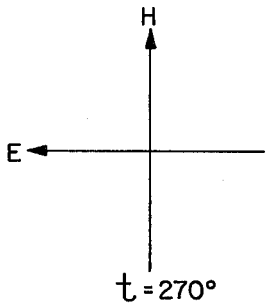
Figure 22E:
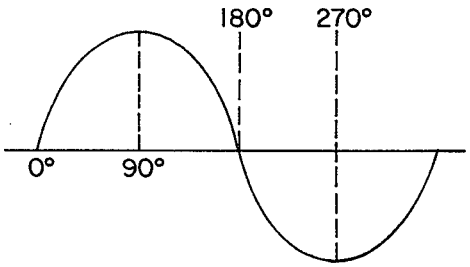

The Vectors which are illustrated in FIGS. 22A through 22D show the directions of the magnetic field intensity (H) and the electric field intensity (E) at four times, each spaced 90° apart in the cycle of the signal of FIG. 22E to illustrate the clockwise rotation (as shown in these figures) of these fields produced by any antenna treated in accordance with the techniques described above. The result is a circularly polarized corkscrew-type of waveform. By covering a vertically polarized conventional antenna with the permanent dielectric magnet, the antenna is capable of receiving either vertically polarized, horizontally polarized, or circularly polarized signals. It transmits circularly polarized signals. The same thing is true of antenna configurations which ordinarily result in horizontal polarization. Embedding the conductive elements of such antennae in permanently magnetized ceramic materials of the type described above results in a receiving antenna which receives signals transmitted with either vertical or horizontal or circular polarization. When such an antenna is used as a transmitting antenna, the transmitted waveform is a circularly polarized waveform.

This result is a significant and unexpected benefit of the magnetic antenna structures since it is not necessary to increase the transmitter power or otherwise alter a transmitter which previously transmitted either vertically polarized or horizontally polarized waves to convert it into a transmitter for transmitting signals having circular polarization. Comparable results are as readily attainable in receiver antennae.

Figure 23B:
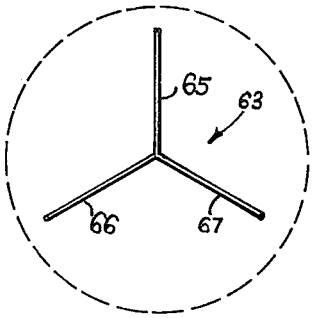
FIGS. 23A and 23B show the radiation pattern of another antenna configuration.
Figure 23A:
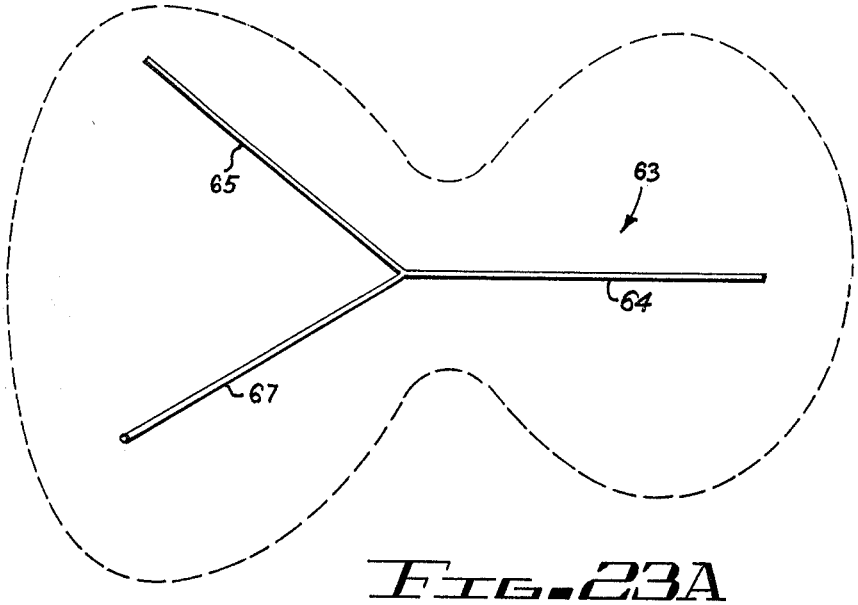

Referring now to FIGS. 23A and 23B, there is shown, in diagrammatic form, a typical configuration of a one-half wave center-fed antenna 63 having four conductive elements 64, 65, 66 and 67 interconnected together at the feed point. The element 64 extends horizontally from the mast 68 of the antenna; and the other three elements 65, 66 and 67 are disposed at a 45° angle to the centerline of the element 64 and are formed about the connection point with the mast 68 in an equilateral triangular configuration. This type of antenna is commonly used in a vertical configuration.

By embedding or coating all four of the antenna elements 64 through 67 in permanently magnetized magnetically hard ceramic material, circular polarization of the antenna results in the generally dumb-bell shaped radiation pattern indicated in dotted lines in FIGS. 23A and 23B. As a result, vertically polarized or horizontally polarized signals coming into the antenna from either the left or the right as viewed in FIG. 23A, produce an output signal from the antenna which has been measured to be greater than a full quarter-wave ground plane antenna. Any signals which enter the antenna field near the point of its connection to the mast 68 and perpendicular to the element 64, produce an output which is of the order of 25 db down from those signals which are applied to the ends of the antenna.

Figure 24A:
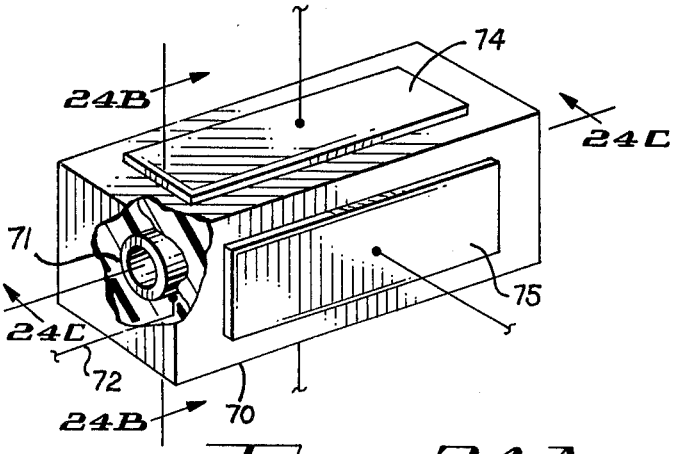
FIGS. 24A to 24C are perspective, cross-sectional and side views of another embodiment of the invention.
Figure 24B:
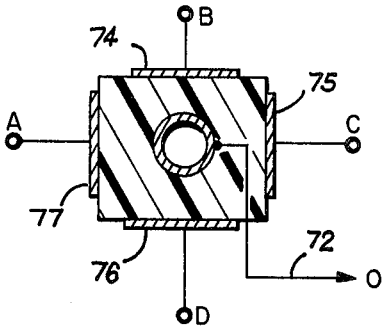
Figure 24C:
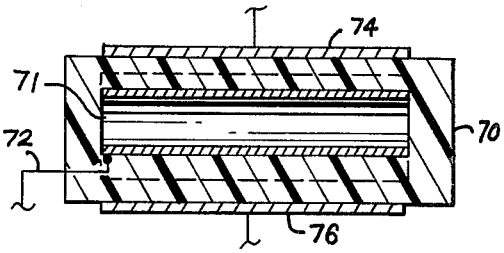

FIGS. 24A through 24C illustrate a device made in accordance with the teachings of this invention which can be used as a mixer, demodulator, amplitude varying circuit, and the like. The structure which permits this operation comprises a rectangular solid body made of permanently magnetized magnetically hard ceramic material 70 in which a hollow cylindrical conductor 71 made of copper or other suitable electrically conducting material has been embedded. An output lead 72 is electrically connected to the conductive cylinder 71 and extends out of the permanent magnet material 70. The formation of this structure and the materials used for the body 70 of the device are similar to the construction of the devices shown in FIGS. 1 and 2 and described above. Attached to the outside longitudinal surfaces of the body 70, are four conductive plates 74, 75, 76 and 77; and each of these plates in turn is illustrated as connected by means of a conductor to an appropriate terminal A, B, C, or D (shown most clearly in FIG. 24B).

By applying input signals across appropriate ones of these plates and by obtaining output signals from the lead 72, the device shown in FIGS. 24A through 24C can be operated in a number of different manners. For example, used as a mixer or demodulator, one input signal can be applied across the terminals A and C and the other across the terminals B and D, with the output being obtained on the lead 72. Applying signals in common to the terminals A and B and another set of signals in common to the terminals C and D results in an operation of the device as a carrier amplitude modulator, if a carrier signal is applied, for example, to terminals A and B connected together and an audio frequency signal is applied to the terminals C and D connected together.

Results similar to those described above, can also be accomplished with a two plate device where only a pair of plates, such as the plates A and C are applied or connected to the outside of the body 70.

Figure 25:
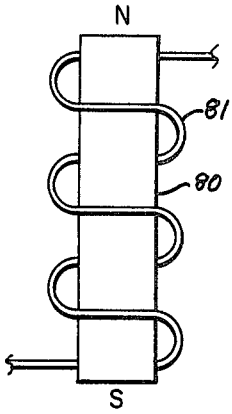
FIG. 25 (PRIOR ART)
FIG. 25 shows a prior art structure.

FIG. 25 illustrates a prior art structure which has been utilized for speakers, microphones and other transducers, such as electric guitar pick-ups. In these devices, a strong permanent magnet 80 is placed inside a coil 81 which is electrically insulated from the magnet 80. The external demagnetizing field which is produced by the magnet 80 is responsive to any changing electrical magnetic or metallic forces moving within its range. When that field is used as a collector or sensor device, the coil 81 then has a current generated in it which is normal to the flux of the magnet. Any decrease or increase of the flux density of the magnet 80 results in a corresponding current flow in the coil 81. For example, the metal strings of a guitar, when they are placed close to one of the poles of the magnet 80, generate a current in the coil 81 when the strings are vibrated. It should be noted that any change in the external demagnetizing field also is present inside the magnetic material. In the prior art devices, such as the one shown in FIG. 25, however, the internal changes in the demagnetizing field are not utilized.

Figure 26:
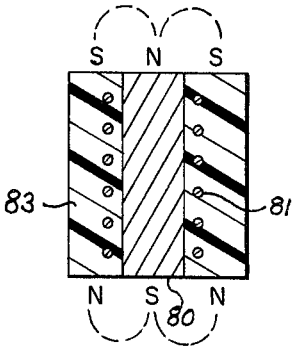
FIGS. 26 and 27 are cross-sectional views of another embodiment of the invention.
Figure 27:
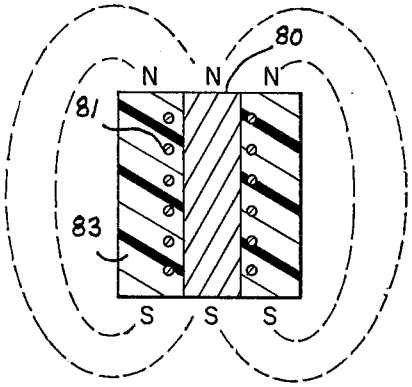

In FIGS. 26 and 27 there is shown a modification of the device shown in FIG. 25, in which the coil 81 is embedded in or covered with a permanently magnetized ceramic material of the type described previously. The conventional strong, permanent magnet 80 also is used in the embodiments of both FIGS. 26 and 27. As a consequence, the coil 81 is located inside the flux fields of both magnets, since the magnetic material 83 provides a return path for the demagnetizing field through the coil 81.

In the structure shown in cross section in FIG. 3, the material 83 is magnetized with the coil 81 in it prior to its being placed over the magnet 80. FIG. 27 shows the coil 81 embedded in the ceramic permanent magnetic material placed over the magnet 80 prior to either the magnet 80 or the material 83 being magnetized. Everything then is magnetized at the same time in the same field. The result of this is to place the coil 81 inside the flux fields of both magnets. The demagnetizing factor is greatly reduced when the magnetizing circuit is removed, and the residual magnetic energy of the composite construction shown in FIG. 27 is much greater than that of the inside magnet 80 alone, approximately 2.5 times as great.

For example, if the energy of the magnetizer for magnetizing the device of FIG. 27 is 10,000 gauss and the magnet 80 alone has a retention of 3,000 gauss when taken out of the magnetizer, it now retains approximately 7,000 gauss out of the field when the construction of FIG. 27 is used. Also the tendency to demagnetize in time is greatly reduced, much like the "keepers" used on old horseshoe magnets to prevent them from demagnetizing themselves.

A greater total flux density is achieved with the magnetization structure shown in FIG. 27 which results in a lower signal level in the coil 81 than for the device of FIG. 26, but a greater fidelity or reproduction of the changes of the field caused by flux changes is obtained with the apparatus of FIG. 27. For example, with a guitar, the signal is greater using the apparatus magnetized as shown in FIG. 26, but the fidelity is greater with the apparatus magnetized as shown in FIG. 27.

The technique illustrated in FIGS. 26 and 27 can be applied to any existing art which uses a magnet-coil method. For speakers and microphones and transducers, substantial improvement in the operation results.

The theory which is common to all of the devices shown and described above is that of utilizing magnetostatic structures as an integral part of the various devices by embedding a conductor or coating it to place it inside a permanently magnetized hard magnetic ceramic material.

I claim:

1. An antenna including in combination:

an elongated electrical conductor embedded in permanently magnetized magnetically hard dielectric material.

2. An antenna according to claim 1 wherein said dielectric material comprises a dielectric carrier having a colloidal dispersion of powdered magnetically hard ferrite therein; and said elongated electrical conductor is embedded in said dielectric material.

3. An antenna according to claim 2 wherein said dielectric material comprises fiber glass impregnated with a resin binder mixed with said ferrite in a ratio from 5 percent to 90 percent ferrite to resin.

4. An antenna according to claim 1 wherein said elongated electrical conductor is potted in said dielectric material and said dielectric material comprises an intimate mixture of a resin binder and magnetically hard ferrite powder.

5. The combination according to claim 4 wherein said ferrite powder is selected from the class comprising isotropic and anisotropic barium ferrites and cobalt ferrites.

6. An antenna according to claim 1 wherein said elongated electrical conductor comprises a helical coil embedded in a fiber glass dielectric impregnated with a resin binder having a colloidal suspension of powdered magnetically hard ferrites in it.

7. The combination according to claim 6 wherein the ratio of the powdered ferrite to resin ranges from 1:20 to 9:10.

8. The combination according to claim 7 wherein said magnetic ferrite is selected from the class comprising barium ferrite and cobalt ferrite.

* * * * *